US010510498B2

(12) United States Patent
Ao et al.

(10) Patent No.: US 10,510,498 B2
(45) Date of Patent: Dec. 17, 2019

(54) TRAVEL SWITCH WITH HIGH-SAFETY LEVER STRUCTURE

(71) Applicant: Albert Chi Man Ao, Chino Hills, CA (US)

(72) Inventors: Albert Chi Man Ao, Chino Hills, CA (US); Yuanhao Zhong, Chino Hills, CA (US)

(73) Assignee: Albert Chi Man Ao, Chino Hills, CA (US)

( * ) Notice: Subject to any disclaimer, the term of this patent is extended or adjusted under 35 U.S.C. 154(b) by 0 days.

(21) Appl. No.: 16/148,391

(22) Filed: Oct. 1, 2018

(65) Prior Publication Data

US 2019/0326076 A1 Oct. 24, 2019

(30) Foreign Application Priority Data

Apr. 23, 2018 (CN) ..... 2018 1 0369297

(51) Int. Cl.
*H01H 13/14* (2006.01)
*H01H 13/10* (2006.01)

(52) U.S. Cl.
CPC ..... *H01H 13/14* (2013.01); *H01H 13/10* (2013.01); *H01H 2221/024* (2013.01); *H01H 2225/012* (2013.01); *H01H 2235/028* (2013.01)

(58) Field of Classification Search
CPC .. H01H 13/14; H01H 13/10; H01H 2221/024; H01H 2225/012; H01H 2235/028
USPC ..... 200/405, 407–409, 449, 453, 459–461, 200/275, 238, 239, 241, 242, 245, 246, 200/249–251, 286, 502
See application file for complete search history.

(56) References Cited

U.S. PATENT DOCUMENTS 2,773,955 A * 12/1956 Haydon ..... H01H 1/20 200/461
3,989,914 A * 11/1976 Stearley ..... H01H 3/38 200/453

* cited by examiner

*Primary Examiner* — Edwin A. Leon
*Assistant Examiner* — Lheiren Mae A Caroc
(74) *Attorney, Agent, or Firm* — ScienBiziP, P.C.

(57) ABSTRACT

A travel switch with a high-safety lever structure comprises a travel adjustment device, a transmission device, a lever-structure electric-connection switch assembly, an insulation assembly and a rivet fixing assembly; the switch assembly comprises a dual-energy-storage-reed structure and a stationary contact piece; the dual-energy-storage-reed structure comprises a stationary reed and a moving reed; the moving reed and the stationary reed are spaced apart at one end, and the moving reed is connected to the stationary reed at another end; the moving reed has energy storage reeds and a moving contact; the stationary reed has energy storage reed positioning hooks; the energy storage reed hooks the energy storage reed positioning hook in a matched mode; the stationary contact piece has a stationary contact; a moving contact limiting block is on the stationary reed; the moving contact connects the stationary contact, and the moving contact corresponds to the moving contact limiting block.

8 Claims, 4 Drawing Sheets

TRAVEL SWITCH WITH HIGH-SAFETY LEVER STRUCTURE

TECHNICAL FIELD

The present disclosure relates to the technical field of travel switches, temperature controllers and humidity controllers, and more particularly, to a travel switch with a high-safety lever structure.

BACKGROUND

A travel switch can determine the presence or absence, passing, positioning and end of travel of an object. Due to their ruggedness, ease of installation and reliability of operation, travel switches are used in a variety of applications such as electric heating equipment, household appliances and kitchen appliances, etc. A traditional travel switch normally includes a travel adjustment device, a transmission device, a lever-structure electric-connection switch assembly, an insulation assembly and a rivet fixing assembly. In the conventional art, the lever-structure electric-connection switch assembly comprises a wiring terminal, an upper reed, a moving reed and a stationary contact piece. As the elastic piece on the moving reed adopts a single-energy-storage-reed structure, it can easily lose elasticity or even fail after prolonged use. As a result, the contacts cannot be operated to break an electrical connection, resulting in a severe damage of related equipment. Improvement in the art is preferred.

In conclusion, the shortcomings of traditional travel switches are urgent problems that need to be solved for those skilled in this field.

SUMMARY

The purpose of the present disclosure is to provide a travel switch with a high-safety lever structure. The present disclosure adopts a dual-energy-storage-reed structure. The two sides of the moving reed are respectively provided with an energy storage reed, and an end portion of the energy storage reed is provided with an energy storage reed positioning end. The two sides of the stationary reed are respectively provided with an energy storage reed positioning hook, and the open end of the energy storage reed is hooked with the energy storage reed positioning hook in a matched mode. Compared with the traditional single-energy-storage-reed structure, the dual-energy-storage-reed structure of the present disclosure can greatly improve the elasticity of the elastic piece. When the elastic piece loses elasticity, the moving contact and the stationary contact can be kept separated. Thus, the failure of breaking the electrical connection caused by the insufficient elasticity of the energy storage reed can be prevented. Meanwhile, according to the present disclosure, the lever-structure electric-connection switch assembly can avoid causing a poor contact when the moving contact touches the stationary contact, thereby effectively protecting the moving contact and the stationary contact from being burnt out due to the continuous sparking between them. Thus, the circuit instability and the switch failure can be prevented. Moreover, even if the energy storage reed fails, the moving contact and the stationary contact can be permanently separated. Thus, the circuit can be quickly cut-off, significantly improving the operating safety of the equipment.

To achieve the above purpose, the present disclosure adopts the following technical solution:

A travel switch with a high-safety lever structure comprising a travel adjustment device, a transmission device, a lever-structure electric-connection switch assembly, an insulation assembly and a rivet fixing assembly; the lever-structure electric-connection switch assembly comprises a dual-energy-storage-reed structure and a stationary contact piece; the dual-energy-storage-reed structure comprises a stationary reed and a moving reed; one end of the moving reed and the stationary reed are arranged at intervals, and the other end of the moving reed is fixedly connected with the stationary reed; the two sides of the moving reed are respectively provided with an energy storage reed; one end of the energy storage reed is connected with the main body of the moving reed, and the other end of the energy storage reed is provided with an open end; the two sides of the stationary reed are respectively provided with an energy storage reed positioning hook, and the open end of the energy storage reed is hooked with the energy storage reed positioning hook in a matched mode; the moving reed is provided with a moving contact, and the stationary contact piece is provided with a stationary contact; a moving contact limiting block is arranged on the stationary reed; an upper portion of the moving contact is correspondingly connected with the stationary contact, and a lower portion of the moving contact is arranged to correspond to the moving contact limiting block.

In another aspect of the present disclosure, a stationary reed soldering platform is arranged on the stationary reed, and a moving reed soldering face is arranged on the moving reed. The stationary reed soldering platform is fixedly soldered with the moving reed soldering face. A first positioning hole is formed in the stationary reed soldering platform, and a second positioning hole is formed in the moving reed soldering face. The first positioning hole and the second positioning hole are arranged to correspond to each other.

In another aspect of the present disclosure, the two sides of the stationary reed are respectively provided with a first reinforcing rib. A positioning notch is formed in the tail portion of the stationary reed. The two sides of the moving reed are respectively provided with a second reinforcing rib. A positioning convex piece is arranged at the end portion of one end of the moving reed. The positioning convex piece of the moving reed is arranged to correspond to the positioning notch of the stationary reed.

In another aspect of the present disclosure, the stationary reed and the stationary contact piece are respectively fixed on the insulation assembly of the travel switch. A hollow rivet fixing hole is formed in one end of the stationary reed, and the stationary reed is fixed on the insulation assembly through the hollow rivet fixing hole. The stationary reed is further connected with a wiring terminal. The wiring terminal is externally connected with a power supply, and a plurality of anti-skid convex points are uniformly arranged on a peripheral portion of the hollow rivet fixing hole.

In another aspect of the present disclosure, a positioning column fixing slot corresponding to the travel adjustment device of the travel switch is arranged on the moving reed. The travel adjustment device comprises a pressing plate, an adjusting screw and a positioning column. A bottom portion of the positioning column is provided with a conical convex tip, which is arranged in the positioning column fixing slot in a matched mode. A top portion of the positioning column abuts against a bottom portion of the adjusting screw. The adjusting screw is in threaded connection with one end of the pressing plate, and the other end of the pressing plate is fixed on the insulation assembly.

In another aspect of the present disclosure, the transmission device comprises a transmission ceramic part. The transmission ceramic part comprises a cylindrical end, a limiting circular ring and a conical end. A transmission ceramic part limiting hole is formed in the stationary reed. The diameter of the limiting hole is greater than that of the cylindrical end of the transmission ceramic part, and is smaller than that of the limiting circular ring of the transmission ceramic part. A transmission ceramic part inverted buckle is arranged on the moving reed. The transmission ceramic part inverted buckle adopts a structure having three sides incised and one side connected with the main body of the moving reed. A circular opening is formed in the transmission ceramic part inverted buckle. The diameter of the circular opening is smaller than that of the cylindrical end of the transmission ceramic part. The cylindrical end of the transmission ceramic part penetrates through the limiting hole of the transmission ceramic part, thereby forcing open the ceramic part inverted buckle so that the cylindrical end is unidirectionally clamped in the circular opening.

In another aspect of the present disclosure, the insulation assembly comprises a first ceramic ring, a second ceramic ring and a third ceramic ring. The first ceramic ring, the second ceramic ring and the third ceramic ring are strung together and fixed via the rivet fixing assembly. Both the stationary reed and the wiring terminal are fixed between the first ceramic ring and the second ceramic ring, and the stationary contact piece is fixed between the second ceramic ring and the third ceramic ring.

In another aspect of the present disclosure, a displacement transmission steel sheet is arranged on the travel switch. One end of the displacement transmission steel sheet is fixed with a bottom portion of the insulation assembly, and the other end of the displacement transmission steel sheet abuts against a bottom portion of the transmission ceramic part of the transmission device.

In another aspect of the present disclosure, the rivet fixing assembly comprises a hollow rivet.

Compared with the prior art, the present disclosure has the following advantages:

First, the present disclosure adopts a dual-energy-storage-reed structure. The two sides of the moving reed are respectively provided with an energy storage reed, and the end portion of the energy storage reed is provided with an energy storage reed positioning end. The two sides of the stationary reed are respectively provided with an energy storage reed positioning hook, and the open end of the energy storage reed is hooked with the energy storage reed positioning hook in a matched mode. Compared with the traditional single-energy-storage-reed structure, the dual-energy-storage-reed structure of the present disclosure can greatly improve the elasticity of the elastic piece. When the elastic piece loses elasticity, the moving contact and the stationary contact can be kept separated. Thus, the failure of breaking the electrical connection caused by the insufficient elasticity of the energy storage reed can be prevented.

Second, the lever-structure electric-connection switch assembly can avoid causing a poor contact when the moving contact touches the stationary contact, thereby effectively protecting the moving contact and the stationary contact from being burnt out due to the continuous sparking between them. Thus, the circuit instability and the switch failure can be prevented.

Third, even if the energy storage reed fails, the moving contact and the stationary contact can be permanently separated. Thus, the circuit can be quickly cut-off, significantly improving the operating safety of the equipment.

BRIEF DESCRIPTION OF THE DRAWINGS

To clearly expound the technical solution of the present disclosure, the drawings and embodiments are hereinafter combined to illustrate the present disclosure. Obviously, the drawings are merely some embodiments of the present disclosure and those skilled in the art can associate themselves with other drawings without paying creative labor.

LISTING OF COMPONENT IN THE DRAWINGS

1 Stationary Reed, 10 Hollow Rivet Fixing Hole, 11 Positioning Notch, 12 Energy Storage Reed Positioning Hook, 13 Stationary Reed Soldering Platform, 14 The First Positioning Hole, 15 Moving Contact Limiting Block, 16 Anti-skid Convex Point, 17 Transmission Ceramic Part Limiting Hole, 18 The First Reinforcing Rib, 2 Moving Reed, 20 Moving Contact, 21 Positioning Convex Piece, 22 Energy Storage Reed, 23 Moving Reed Soldering Face, 24 The Second Positioning Hole, 25 Transmission Ceramic Part Inverted Buckle, 26 Positioning Column Fixing Slot, 27 Circular Opening, 28 The Second Reinforcing Rib, 3 Pressing Plate, 4 Hollow Rivet, 40 Displacement Transmission Steel Sheet, 5 Adjusting Screw, 50 Wiring Terminal, 6 Positioning Column, 7 Transmission Ceramic Part, 71 Cylindrical End, 72 Limiting Circular Ring, 73 Conical End, 8 Stationary Contact Piece, 80 Stationary Contact, 9 The First Ceramic Ring, 90 The Second Ceramic Ring, 91 The Third Ceramic Ring

DETAILED DESCRIPTION

Drawings and detailed embodiments are combined hereinafter to elaborate the technical principles of the present disclosure.

Figure 1:
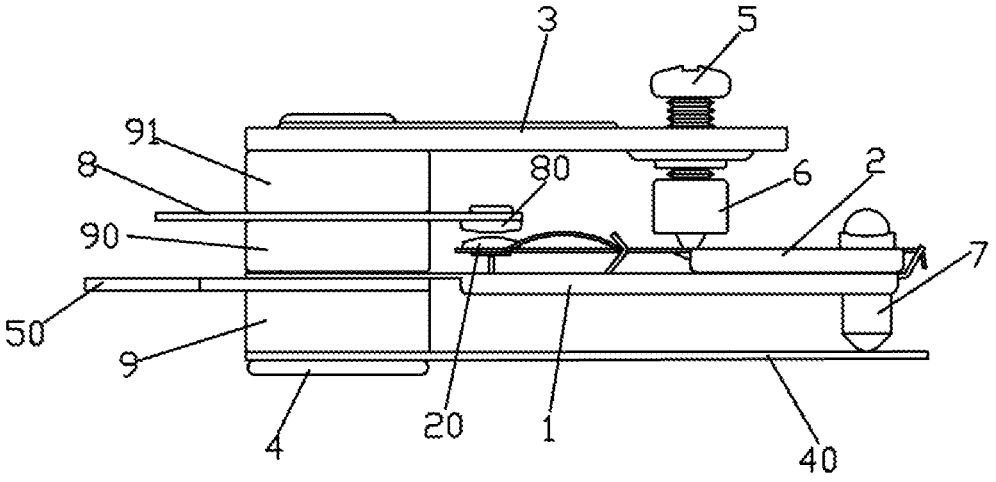
FIG. 1 is a structural diagram in accordance with the present disclosure.
Figure 2:
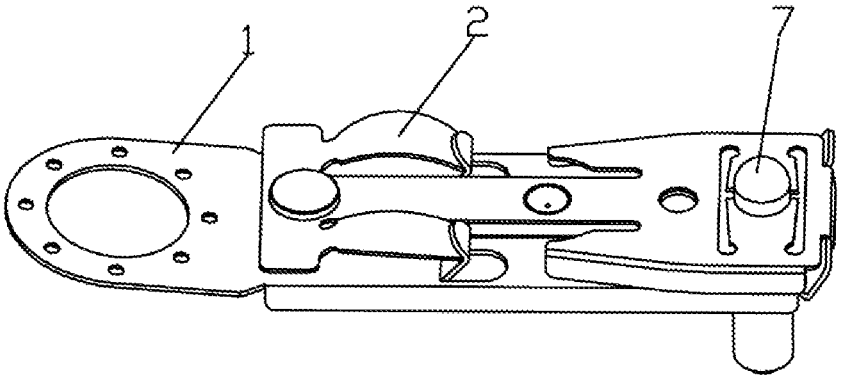
FIG. 2 is a structural diagram of the dual-energy-storage-reed structure in the lever-structure electric-connection switch assembly in accordance with the present disclosure.
Figure 3:
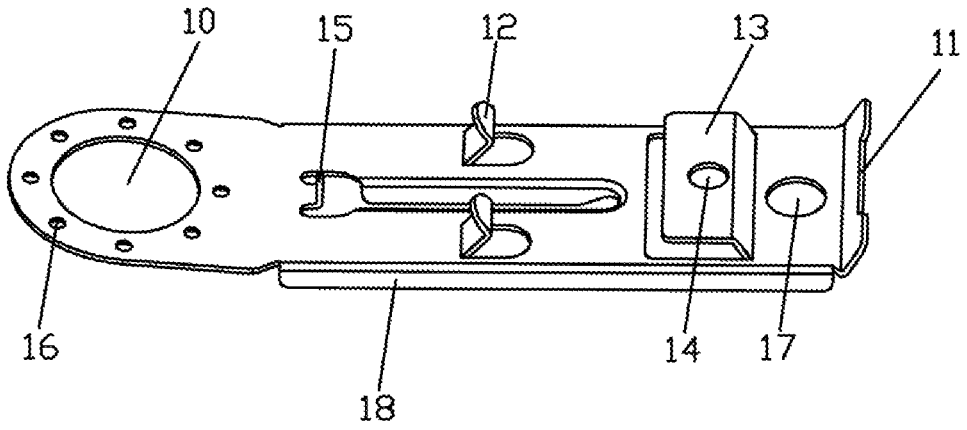
FIG. 3 is a structural diagram of the stationary reed in accordance with the present disclosure.
Figure 4:
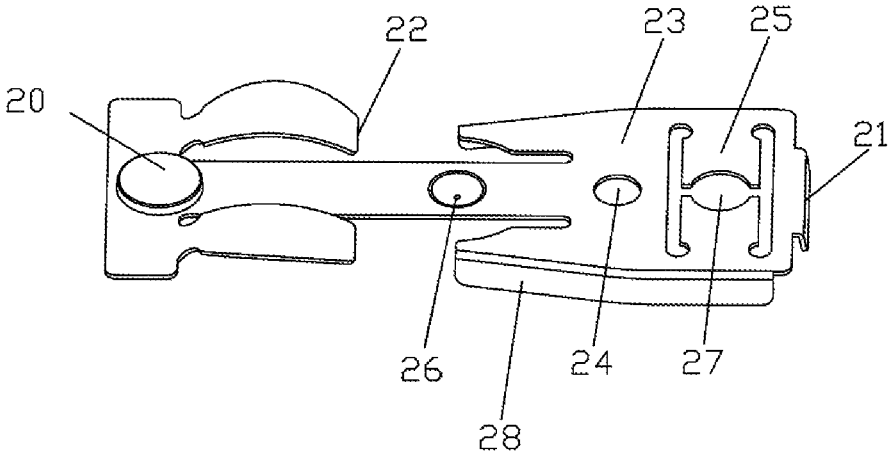
FIG. 4 is a structural diagram of the moving reed in accordance with the present disclosure.
Figure 5:
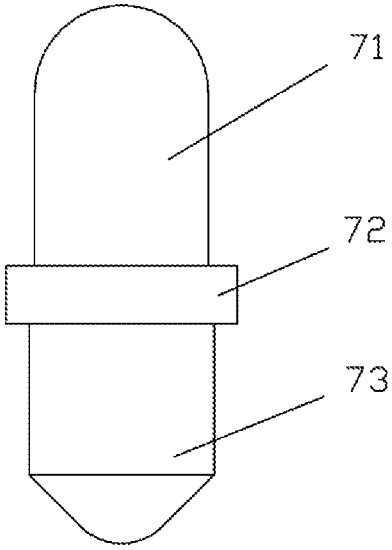
FIG. 5 is a structural diagram of the transmission ceramic part in accordance with the present disclosure.
Figure 6:
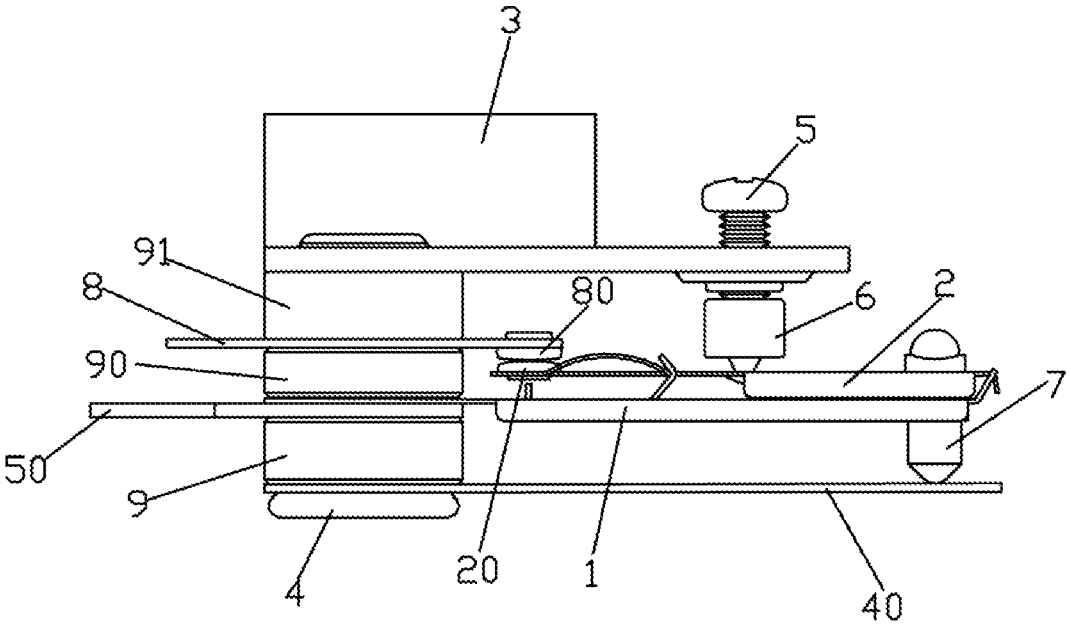
FIG. 6 is a structural diagram of a duplex travel switch in accordance with the present disclosure.
Figure 7:
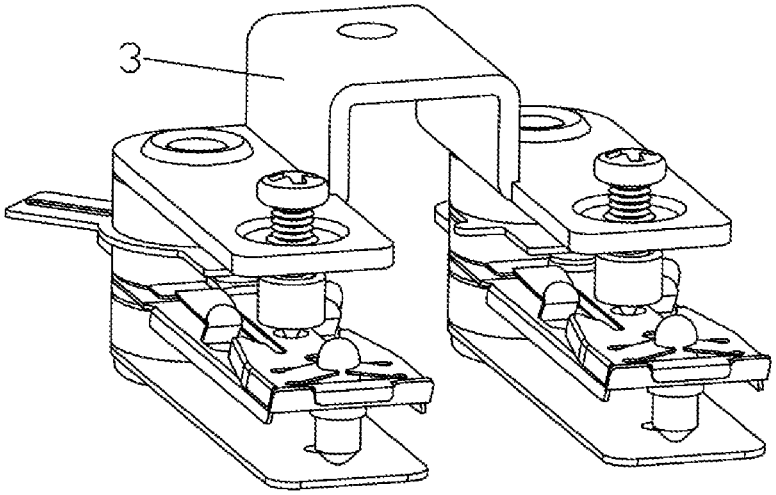
FIG. 7 is a perspective view of the duplex travel switch in according with the present disclosure.

As shown in FIGS. 1-7, the travel switch with a high-safety lever structure of the present disclosure comprises a travel adjustment device, a transmission device, a lever-structure electric-connection switch assembly, an insulation assembly and a rivet fixing assembly. The lever-structure electric-connection switch assembly comprises a dual-energy-storage-reed structure and a stationary contact piece 8. The dual-energy-storage-reed structure comprises a stationary reed 1 and a moving reed 2. One end of the moving reed 2 and the stationary reed 1 are arranged at intervals, and the other end of the moving reed 2 is fixedly connected with the stationary reed 1. Two sides of the moving reed 2 are respectively provided with an energy storage reed 22. One end of the energy storage reed 22 is connected with the main body of the moving reed 2, and the other end of the energy storage reed 22 is provided with an open end. Two sides of the stationary reed 1 are respectively provided with an energy storage reed positioning hook 12, and an open end of the energy storage reed 22 is hooked with the energy storage reed positioning hook 12 in a matched mode. The moving reed 2 is provided with a moving contact 20, and the stationary contact piece 8 is provided with a stationary contact 80. A moving contact limiting block 15 is arranged on the stationary reed 1. An upper portion of the moving contact 20 is correspondingly connected with the stationary contact 80, and a lower portion of the moving contact 20 is arranged to correspond to the moving contact limiting block 15. The aforesaid description forms the basic structure of the present disclosure.

In the present embodiment, the two sides of the moving reed 2 are respectively provided with an energy storage reed 22. One end of the energy storage reed 22 is connected with the main body of the moving reed 2, and the other end of the energy storage reed 22 is provided with an open end. The two sides of the stationary reed 1 are respectively provided with an energy storage reed positioning hook 12, and the open end of the energy storage reed 22 is hooked with the energy storage reed positioning hook 12 in a matched mode. According to the aforesaid design, effects such as forced limiting and energy storage of the energy storage reed 22 can be achieved. The energy storage reed 22 is used for forcing the moving contact 20 to touch or separate from the stationary contact 80 after the energy is sufficiently stored. Thus, the open or closed state of the circuit can be achieved. Compared with the traditional single-energy-storage-reed structure, the dual-energy-storage-reed structure of the present disclosure can greatly improve the elasticity of the elastic piece. When the elastic piece loses elasticity, the moving contact and the stationary contact can be kept separated. Thus, the failure of breaking the electrical connection caused by the insufficient elasticity of the energy storage reed can be prevented. Meanwhile, according to the present disclosure, the lever-structure electric-connection switch assembly can avoid causing a poor contact when the moving contact touches the stationary contact, thereby effectively protecting the moving contact and the stationary contact from being burnt out due to continuous sparking between them. Thus, the circuit instability and the switch failure can be prevented. Moreover, even if the energy storage reed fails, the moving contact and the stationary contact can be permanently separated. Thus, the circuit can be quickly cut-off, significantly improving the operating safety of the equipment. In the present embodiment, the moving contact limiting block 15 is used for limiting the moving contact 20. Thus, the effect of limiting the moving distance of the moving contact can be achieved.

Specifically, a stationary reed soldering platform 13 is arranged on the stationary reed 1, and a moving reed soldering face 23 is arranged on the moving reed 2. The stationary reed soldering platform 13 is fixedly soldered with the moving reed soldering face 23. A first positioning hole 14 is formed in the stationary reed soldering platform 13, and a second positioning hole 24 is formed in the moving reed soldering face 23. The first positioning hole 14 and the second positioning hole 24 are arranged to correspond to each other. According to this configuration, when the moving reed 2 and the stationary reed 1 are soldered together, an accurate positioning and a precise assembly can be achieved.

The two sides of the stationary reed are respectively provided with a first reinforcing rib 18. A positioning notch 11 is formed in a tail portion of the stationary reed 1. The two sides of the moving reed 2 are respectively provided with a second reinforcing rib 28. A positioning convex piece 21 is arranged at an end portion of one end of the moving reed 2. The positioning convex piece 21 of the moving reed 2 is arranged to correspond to the positioning notch 11 of the stationary reed 1. With the aforesaid structure, the rigidity of the stationary reed 1 and the moving reed 2 can be greatly enhanced.

Furthermore, the stationary reed 1 and the stationary contact piece 8 are respectively fixed on the insulation assembly of the travel switch. A hollow rivet fixing hole 10 is formed in one end of the stationary reed 1, and the stationary reed is fixed on the insulation assembly through the hollow rivet fixing hole 10. The stationary reed 1 is further connected with a wiring terminal 50. The wiring terminal 50 is externally connected with a power supply, and a plurality of anti-skid convex points 16 are uniformly arranged on a peripheral portion of the hollow rivet fixing hole 10. According to the aforesaid technical solution, the frictional force can be significantly increased during assembly, the displacement of the stationary reed 1 can be prevented, and the moving contact 20 can be protected from being separated from the stationary contact 80.

A positioning column fixing slot 26 corresponding to the travel adjustment device of the travel switch is arranged on the moving reed 2. The travel adjustment device comprises a pressing plate 3, an adjusting screw 5 and a positioning column 6. The bottom portion of the positioning column 6 is provided with a conical convex tip, which is arranged in the positioning column fixing slot 26 in a matched mode. The top portion of the positioning column 6 abuts against the bottom portion of the adjusting screw 5. The adjusting screw 5 is in threaded connection with one end of the pressing plate 3, and the other end of the pressing plate is fixed on the insulation assembly. According to this design, the positioning column 6 can be propelled to move up and down through the rotation of the adjusting screw 5, thereby effectively limiting the moving reed 2 (equivalent to a set value). Its operating principle is to turn the positioning column fixing slot 26 into a lever fulcrum under the condition that one end of the moving reed 2 is stressed, thereby utilizing the lever principle to separate the moving contact 20 on the other end of the moving reed 2 from the stationary contact 80 through the stored elasticity of the energy storage reed 22. Thus, the circuit can be cut-off. The bottom portion of the positioning column 6 is provided with a conical convex tip, which is arranged in the positioning column fixing slot 26 in a matched mode, allowing the positioning column 6 to contact the positioning column fixing slot 26 with a convex tip instead of a surface while being positioned.

The transmission device of the present disclosure comprises a transmission ceramic part 7. The transmission ceramic part 7 comprises a cylindrical end 71, a limiting circular ring 72 and a conical end 73. A transmission ceramic part limiting hole 17 is formed in the stationary reed 1. The diameter of the limiting hole 17 is greater than a diameter of the cylindrical end 71 of the transmission ceramic part 7, and is smaller than a diameter of the limiting circular ring 72 of the transmission ceramic part 7. A transmission ceramic part inverted buckle 25 is arranged on the moving reed 2. The transmission ceramic part inverted buckle 25 adopts a structure with three sides incised and one side connected with the main body of the moving reed 2. A circular opening 27 is formed in the transmission ceramic part inverted buckle 25. A diameter of the circular opening 27 is smaller than the diameter of the cylindrical end 71 of the transmission ceramic part 7. The cylindrical end 71 of the transmission ceramic part 7 penetrates through the limiting hole 17 of the transmission ceramic part 7, thereby forcing open the ceramic part inverted buckle 25. Thus, the cylindrical end 71 is unidirectionally clamped in the circular opening 27. Under the interaction of the transmission ceramic part limiting hole 17 in the stationary reed 1 and the transmission ceramic part inverted buckle 25 on the moving reed 2, the transmission ceramic part can be limited and fixed. In this way, the purpose of replacing the traditional transmission ceramic part can be achieved. The operating principle is the following: the vertex of the conical end 73 of the transmission ceramic part 7 slides on the surface of displacement transmission steel sheet 40, and the displacement variation is subsequently transmitted to the displacement transmission steel sheet 40 and the transmission ceramic part 7, enabling the stationary reed 1 and the moving reed 2 to be jacked up or move down to reset. Moreover, the positioning column 6 in the travel adjustment device abuts against the positioning column fixing slot 26 in the moving reed 2, thereby forming a lever fulcrum. Thus, the lever-structure electric-connection switch assembly can operate to make or break an electrical connection.

Specifically, the insulation assembly comprises a first ceramic ring 9, a second ceramic ring 90 and a third ceramic ring 91. The first ceramic ring 9, the second ceramic ring 90 and the third ceramic ring 91 are strung together and fixed via the rivet fixing assembly. Both the stationary reed 1 and the wiring terminal 50 are fixed between the first ceramic ring 9 and the second ceramic ring 90, and the stationary contact piece 8 is fixed between the second ceramic ring 90 and the third ceramic ring 91. In this configuration, the first ceramic ring 9, the second ceramic ring 90 and the third ceramic ring 91 are strung together and fixed via the rivet fixing assembly. Furthermore, the stationary reed 1 and the stationary contact piece 8 are arranged at intervals, thereby achieving the corresponding connection between the moving contact 20 and the stationary contact 80.

A displacement transmission steel sheet 40 is arranged on the travel switch. One end of the displacement transmission steel sheet 40 is fixed with the bottom portion of the insulation assembly, and the other end of the displacement transmission steel sheet 40 abuts against the bottom portion of the transmission ceramic part 7 of the transmission device. According to this arrangement, the displacement transmission steel sheet 40 can be pushed to propel the transmission ceramic part 7 to move upwards. As a result, the dual-energy-storage-reed structure is propelled to work, thereby cutting-off the circuit.

The rivet fixing assembly comprises a hollow rivet 4.

The present disclosure serves as a part of a travel switch or a temperature controller. The operating principle of the present disclosure is the following:

During the operation of the equipment, when the minimum preset displacement value is reached, the displacement transmission steel sheet 40 and the transmission ceramic part 7 are pushed to propel the dual-energy-storage-reed structure to move up. Under the action of the lever fulcrum of the positioning column 6 of the travel adjustment device, the moving reed 2 functions as a lever. Thus, the moving contact 20 and the stationary contact 80 can be separated through the stored energy of the moving reed 2, thereby cutting-off the circuit and stopping the equipment. When the displacement is returned to the initial state, the circuit is closed once again. In this way, the equipment can be effectively controlled.

Compared with the traditional single-energy-storage-reed structure, the dual-energy-storage-reed structure of the present disclosure can greatly improve the elasticity of the elastic piece. When the elastic piece loses elasticity, the moving contact and the stationary contact can be kept separated. Thus, the failure of breaking the electrical connection caused by the insufficient elasticity of the energy storage reed can be prevented. Meanwhile, according to the present disclosure, the lever-structure electric-connection switch assembly can avoid causing a poor contact when the moving contact touches the stationary contact, thereby effectively protecting the moving contact and the stationary contact from being burnt out due to the continuous sparking between them. Thus, the circuit instability and the switch failure can be prevented. Moreover, even if the energy storage reed fails, the moving contact and the stationary contact can be permanently separated. Thus, the circuit can be quickly cut-off, significantly improving the operating safety of the equipment.

The description of above embodiments allows those skilled in the art to realize or use the present disclosure. Without departing from the spirit and essence of the present disclosure, those skilled in the art can combine, change or modify correspondingly according to the present disclosure. Therefore, the protective range of the present disclosure should not be limited to the embodiments above but conform to the widest protective range which is consistent with the principles and innovative characteristics of the present disclosure. Although some special terms are used in the description of the present disclosure, the scope of the disclosure should not necessarily be limited by this description. The scope of the present disclosure is defined by the claims.

The invention claimed is:

1. A travel switch with a high-safety lever structure, comprising:

a travel adjustment device;

a transmission device;

a lever-structure electric-connection switch assembly;

an insulation assembly; and a rivet fixing assembly;

wherein the lever-structure electric-connection switch assembly comprises a dual-energy-storage-reed structure and a stationary contact piece, wherein the dual-energy-storage-reed structure comprises a stationary reed and a moving reed, wherein one end of the moving reed and the stationary reed are arranged in intervals, and another end of the moving reed is fixedly connected with the stationary reed, wherein two sides of the moving reed are respectively provided with an energy storage reed, wherein one end of the energy storage reed is connected with a main body of the moving reed, and another end of the energy storage reed is provided with an open end, wherein two sides of the stationary reed are respectively provided with an energy storage reed positioning hook, and the open end of the energy storage reed is hooked with the energy storage reed positioning hook in a matched mode, wherein the moving reed is provided with a moving contact, and the stationary contact piece is provided with a stationary contact, wherein a moving contact limiting block is arranged on the stationary reed, wherein an upper portion of the moving contact is correspondingly connected with the stationary contact, and a lower portion of the moving contact is arranged to correspond to the moving contact limiting block; and wherein the two sides of the stationary reed are respectively provided with a first reinforcing rib, wherein a positioning notch is formed in a tail portion of the stationary reed, wherein the two sides of the moving reed are respectively provided with a second reinforcing rib, wherein a positioning convex piece is arranged at an end portion of one end of the moving reed, wherein the positioning convex piece of the moving reed is arranged to correspond to the positioning notch of the stationary reed.

2. The travel switch with a high-safety lever structure of claim 1, wherein a stationary reed soldering platform is arranged on the stationary reed, and a moving reed soldering face is arranged on the moving reed, wherein the stationary reed soldering platform is fixedly soldered with the moving reed soldering face, wherein a first positioning hole is formed in the stationary reed soldering platform, and a second positioning hole is formed in the moving reed soldering face, wherein the first positioning hole and the second positioning hole are arranged to correspond to each other.

3. The travel switch with a high-safety lever structure of claim 1, wherein the stationary reed and the stationary contact piece are respectively fixed on the insulation assembly of the travel switch, wherein a hollow rivet fixing hole is formed in one end of the stationary reed, and the stationary reed is fixed on the insulation assembly through the hollow rivet fixing hole, wherein the stationary reed is further connected with a wiring terminal, wherein the wiring terminal is externally connected with a power supply, and a plurality of anti-skid convex points is uniformly arranged on a peripheral portion of the hollow rivet fixing hole.

4. The travel switch with a high-safety lever structure of claim 1, wherein a positioning column fixing slot corresponding to the travel adjustment device of the travel switch is arranged on the moving reed, wherein the travel adjustment device comprises a pressing plate, an adjusting screw and a positioning column, wherein a bottom portion of the positioning column is provided with a conical convex tip, the conical convex tip is arranged in the positioning column fixing slot in a matched mode, wherein a top portion of the positioning column abuts against a bottom portion of the adjusting screw, wherein the adjusting screw is in threaded connection with one end of the pressing plate, and another end of the pressing plate is fixed on the insulation assembly.

5. The travel switch with a high-safety lever structure of claim 1, wherein the transmission device comprises a transmission ceramic part, wherein the transmission ceramic part comprises a cylindrical end, a limiting circular ring and a conical end, wherein a transmission ceramic part limiting hole is formed in the stationary reed, wherein a diameter of the transmission ceramic part limiting hole is greater than a diameter of the cylindrical end of the transmission ceramic part and is smaller than a diameter of the limiting circular ring of the transmission ceramic part, wherein a transmission ceramic part inverted buckle is arranged on the moving reed, wherein the transmission ceramic part inverted buckle has three sides incised and one side connected with the main body of the moving reed, wherein a circular opening is formed in the transmission ceramic part inverted buckle, wherein a diameter of the circular opening is smaller than the diameter of the cylindrical end of the transmission ceramic part, wherein the cylindrical end of the transmission ceramic part penetrates through the transmission ceramic part limiting hole of the transmission ceramic part, thereby forcing open the ceramic part inverted buckle so that the cylindrical end is unidirectionally clamped in the circular opening.

6. The travel switch with a high-safety lever structure of claim 1, wherein the insulation assembly comprises a first ceramic ring, a second ceramic ring and a third ceramic ring, wherein the first ceramic ring, the second ceramic ring and the third ceramic ring are strung together and fixed via the rivet fixing assembly, wherein the stationary reed and a wiring terminal are fixed between the first ceramic ring and the second ceramic ring, and the stationary contact piece is fixed between the second ceramic ring and the third ceramic ring.

7. The travel switch with a high-safety lever structure of claim 1, wherein a displacement transmission steel sheet is arranged on the travel switch, wherein one end of the displacement transmission steel sheet is fixed with a bottom portion of the insulation assembly, and another end of the displacement transmission steel sheet abuts against a bottom portion of a transmission ceramic part of the transmission device.

8. The travel switch with a high-safety lever structure of claim 1, wherein the rivet fixing assembly comprises a hollow rivet.

* * * * *